US007065936B2

(12) United States Patent
Lindee et al.

(10) Patent No.: US 7,065,936 B2
(45) Date of Patent: Jun. 27, 2006

(54) FILL AND PACKAGING APPARATUS

(75) Inventors: Scott A. Lindee, Mokena, IL (US); Glenn Sandberg, New Lenox, IL (US); James E. Pasek, Tinley Park, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 10/323,618

(22) Filed: Dec. 18, 2002

(65) Prior Publication Data

US 2004/0118084 A1 Jun. 24, 2004

(51) Int. Cl.
*B65B 3/04* (2006.01)

(52) U.S. Cl. ..... 53/251; 53/247; 53/252; 53/258; 53/260; 53/517

(58) Field of Classification Search ..... 53/527, 53/539, 247, 540, 251, 252, 158, 543, 246, 53/257, 258, 259, 260, 261
See application file for complete search history.

(56) References Cited

U.S. PATENT DOCUMENTS 3,080,033 A * 3/1963 Graeme et al. ..... 193/23
3,354,613 A * 11/1967 Anderson et al. ..... 53/251
3,475,184 A * 10/1969 La Mers et al. ..... 53/440
3,821,913 A * 7/1974 Bajcar et al. ..... 83/92
3,846,958 A * 11/1974 Divan ..... 53/502
3,932,982 A * 1/1976 Klapp ..... 53/244
4,018,326 A * 4/1977 Hardy ..... 198/418.9
4,051,652 A * 10/1977 Hirano et al. ..... 57/270
4,057,951 A 11/1977 Schneider
4,233,799 A * 11/1980 Caille ..... 53/154
4,236,855 A 12/1980 Wagner et al.
4,416,103 A 11/1983 Ewer et al.
4,474,092 A 10/1984 Mally et al.
4,478,024 A 10/1984 Vedvik et al.
4,597,704 A 7/1986 Vedvik et al.
4,645,400 A 2/1987 Mally et al.
4,648,237 A 3/1987 Total
4,667,953 A * 5/1987 Hirakawa et al. ..... 271/280
4,709,535 A 12/1987 Mahaffy et al.
4,960,198 A * 10/1990 Hogenkamp ..... 198/419.2

(Continued)

FOREIGN PATENT DOCUMENTS

EP 1 243 386 A2 9/2002

*Primary Examiner*—Stephen F. Gerrity
*Assistant Examiner*—Thanh Truong
(74) *Attorney, Agent, or Firm*—The Law Office of Randall T. Erickson, P.C.

(57) ABSTRACT

An apparatus is provided for filling food product drafts into packages. A supply of open top containers are arranged in rows and carried by an elongated web of film and are movable by the web into a fill station. A shuttle conveyor has a retractable and extendable conveying surface, the conveying surface arranged above the fill station and having an end region extendable to a position arranged to deposit food product drafts into the containers of the first row by circulation of the conveying surface. The conveying surface is retractable, or extendable, to reposition the end to a position arranged to deposit food product drafts carried on the conveying surface into the containers of the second row and each subsequent row. A tamping apparatus is carried by the conveyor to retract or extend with the conveying surface end. The tamping apparatus has vertically reciprocal tamping elements arranged above the respective row being filled with food product drafts, the tamping elements actuated to press the food product drafts into the containers.

21 Claims, 3 Drawing Sheets

U.S. PATENT DOCUMENTS 4,984,677 A * 1/1991 Prakken ..... 198/418.6
5,051,268 A * 9/1991 Mally ..... 426/420
5,054,266 A 10/1991 Mello et al.
5,095,684 A * 3/1992 Walker et al. ..... 53/443
5,327,704 A 7/1994 Hoekzema et al.
5,692,362 A * 12/1997 Hoyland ..... 53/473
5,720,149 A * 2/1998 Stimpfl ..... 53/244
6,622,848 B1 * 9/2003 Lattimer et al. ..... 198/418.9

* cited by examiner

FILL AND PACKAGING APPARATUS

TECHNICAL FIELD OF THE INVENTION

The invention relates to fill and packaging apparatus. Particularly, the invention relates to an apparatus that slices and packages food products.

BACKGROUND OF THE INVENTION

In a typical fill and package apparatus for sliced food products, a slicer delivers groups of slices or "drafts" onto a conveyor. The drafts are conveyed spaced-apart in a stream to a staging conveyor where the stream is converted to lateral rows of drafts. Such a staging conveyor is described in U.S. Pat. No. 5,810,149 and is commercially available as the A*180 Autoloader from Formax, Inc. of Mokena, Ill., U.S.A.

The rows of drafts are delivered by the staging conveyor to a packaging machine where the rows are deposited sequentially into pockets formed in a moving lower web of film. The rows are deposited while the film is advancing to a dwell position. At the dwell position, the packaging machine stops the motion of the lower web. During the dwell time period, at a downstream sealing station, downstream according to a direction of movement of the lower web of film, the packaging machine seals an upper web of film to the lower web of film after the drafts are placed in the pockets, and then trims the completed packages from the webs. Upstream of the sealing station, upstream according to a direction of movement of the lower web of film, the packaging machine also forms another group of empty pockets during the dwell time period. After the dwell time period is over the lower web of film is advanced and new drafts are deposited into new pockets as the lower web advances to a new dwell position. The dwell time period is longer than the film advance time period for a typical operating cycle, approximately 80% dwell time period compared to 20% film advance time period.

Loading stacks or drafts into the pockets during the advance time period is a time efficient way to load the pockets. Once the row of drafts is staged up onto the end of the staging conveyor, the advancement of the staging conveyor is synchronized with the packaging machine film advance to deposit the drafts into the pockets row-by-row.

However, the present inventors have recognized that "fluff" or "bunch" type products sometimes need to be re-collected correctly in the pockets of the lower web to ensure a neat and compact filling. These products are thin sliced "piles" that resemble hand produced deli portions. They do not "stage" well, as the piles produced by the slicer can tend to elongate during transportation on the conveyors from the slicing machine to the packaging machine.

The present inventors have recognized that it would be desirable to provide a filling and packaging apparatus that neatly and economically fills and packages drafts of thin sliced food product.

SUMMARY OF THE INVENTION

The present invention provides an apparatus that effectively "tightens-up" drafts of thin-sliced piles of food product to fit neatly into packages.

According to the invention, an apparatus is provided for filling food product drafts into packages, comprising:

a supply of open top containers arranged in rows and carried by an elongated web of film and movable by the web into a fill station; and a shuttle conveyor having a retractable and extendable conveying surface, the conveying surface arranged above the fill station and having an end region extendable to a position arranged to deposit the food product drafts into the containers of the first row, the conveying surface then being retractable to reposition the end region to a position arranged to deposit food product drafts carried on the conveying surface into the containers of the second row.

The apparatus of the invention can also include a tamping apparatus carried by the conveyor to retract or extend with the conveying surface end region and having vertically reciprocal tamping elements arranged above the respective first or second row being filled with food product drafts, particularly drafts in the form of bunches, groups or piles of food product. The tamping elements are configured to travel downward to press the food product drafts into the containers.

The apparatus can further comprise a rotatable slicing blade, a conveying assembly, and a support for holding a loaf in a cutting path of the rotatable slicing blade. The rotatable slicing blade is arranged to rotate in the cutting path to slice drafts from the loaf, the drafts being plural slices formed in a pile on the conveying assembly. The conveying assembly includes a staging conveyor that includes a row staging conveyor that forms the piles into rows and transports the rows toward the conveying surface of the shuttle conveyor. The staging conveyor can include one or more in line conveyors for transporting the rows to the shuttle conveyor.

The shuttle conveyor can be configured to fill a group of rows of containers while the web is stationary in the fill station. The shuttle conveyor is configured to advance from a retracted position where the last row of the group is filled to an extended position toward a downstream end of the fill station, simultaneously with advancement of the web to locate a succeeding group of rows of containers in the fill station.

According to an exemplary embodiment of the invention, rows of pockets formed in a web of film are spaced below a shuttle conveyor. During a dwell time period of the packaging machine, when the web of film is stopped, at a fill station, the first row of pockets is filled with the drafts and the drafts are tamped into the pockets. The second row of pockets is then filled and tamped. The steps are repeated, until all the rows in the fill station are filled and tamped during the dwell time period. When the dwell time period is over, the web of film is advanced such that new rows of empty pockets are presented at the fill station.

According to an exemplary embodiment of the invention, the shuttle conveyor is used to fill the first row of pockets with drafts and then retracted to fill the second row of pockets with drafts, and then retracted to fill each subsequent row of pockets with drafts until all of the rows of the group are filled. After the dwell time period is over, at the same time the packaging film advances to a new dwell position, the shuttle conveyor will also advance in order to repeat the cycle for the next group of pocket rows.

Alternatively, the shuttle conveyor could fill the groups of rows in a reverse order to that just described, wherein the first filled row of pockets is the row furthest upstream in the web moving direction, and the shuttle conveyor advances to fill the second row, then advances again to fill the third row, etc. After the group of rows is filled during the dwell period, the web of film advances to present an empty new group of rows of pockets and the shuttle conveyor retracts to be in a starting position to fill the new first row.

Advantageously, to assist in tightening up the drafts in the pocket, the shuttle conveyor is arranged to deposit the drafts into the pocket in an almost vertical attitude.

According to the exemplary embodiment of the invention, each group of pockets includes four rows by four lanes for 16 pockets. Each group of pockets is filled and packaged per dwell cycle of the packaging machine. At 6 cycles per minute (96 packages per minute), there is approximately 8 seconds to fill the pockets (2 seconds to fill and tamp each row) and 2 seconds for the shuttle to return and be ready for the next group of 4 rows of 4 pockets.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
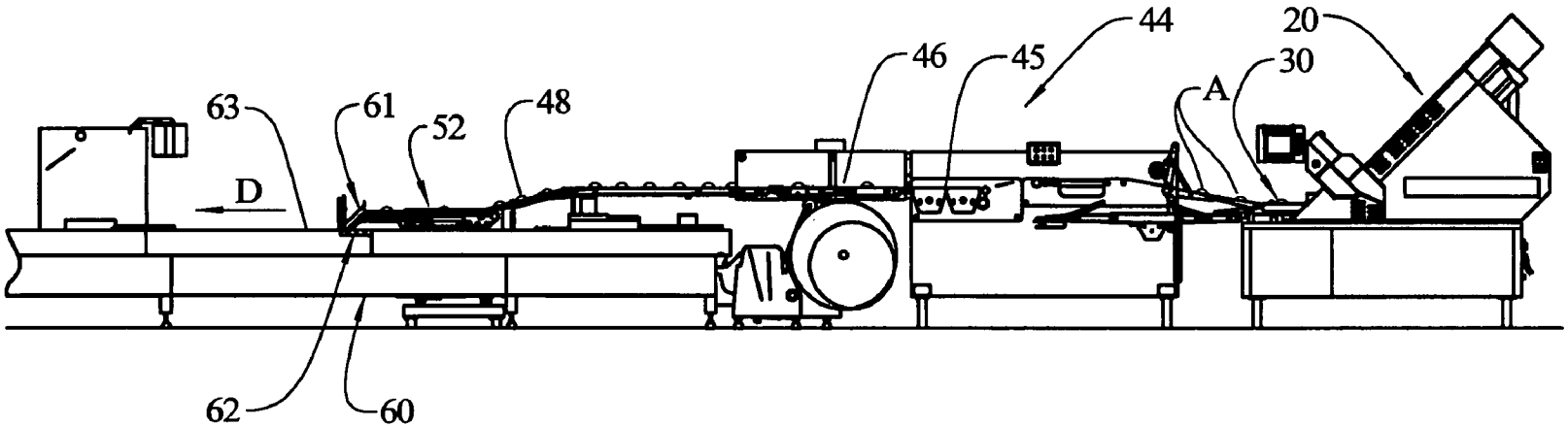
FIG. 1 is a schematic elevational view of a slicing and packaging line that incorporates the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

A system according to the invention includes a slicing machine 20 which cuts slices from a loaf and deposits the slices on an output conveyor assembly 30, forming shingled or stacked drafts A. The drafts can be piles, bunches or groups of thin sliced product. The slicing machine can be of a type as described in U.S. Pat. Nos. 5,649,463; 5,704,265; and 5,974,925; as well as patent publications EP0713753 and WO99/08844, herein incorporated by reference. The slicing machine can also be a commercially available FORMAX FX180 machines, available from Formax, Inc. of Mokena, Ill., U.S.A.

The conveyor assembly 30 includes a check weight conveyor, wherein unacceptable drafts can be rejected and diverted. Acceptable drafts A are moved from the conveyor assembly 30 onto a staging conveyor 44 that includes a row staging conveyor 45 wherein a single file stream of drafts is rearranged in laterally extending rows. Such a staging conveyor 44 is described in U.S. Pat. No. 5,810,149 and is commercially available as the A*180 Autoloader from Formax, Inc. of Mokena, Ill., U.S.A.

The staging conveyor 44 can include an output conveyor 46 and a ramp conveyor 48. The row staging conveyor 45 delivers rows of drafts to the output conveyor 46. The output conveyor delivers the rows of drafts to the ramp conveyor 48. The ramp conveyor delivers the rows of drafts onto a shuttle conveyor 52.

The conveyors 46, 48, 52 are arranged above a packaging machine 60, such as a Multivac R530, available from Multivac, Inc. of Kansas City, Mo., U.S.A. At a fill station 61, the shuttle conveyor 52 delivers rows of drafts into containers in the form of a group of rows of pockets 62 formed in a lower web of film 63 by the packaging machine 60. Downstream of the fill station 61, in the direction D, the pockets 62, filled with product, are sealed by an upper web of film.

Figure 2:
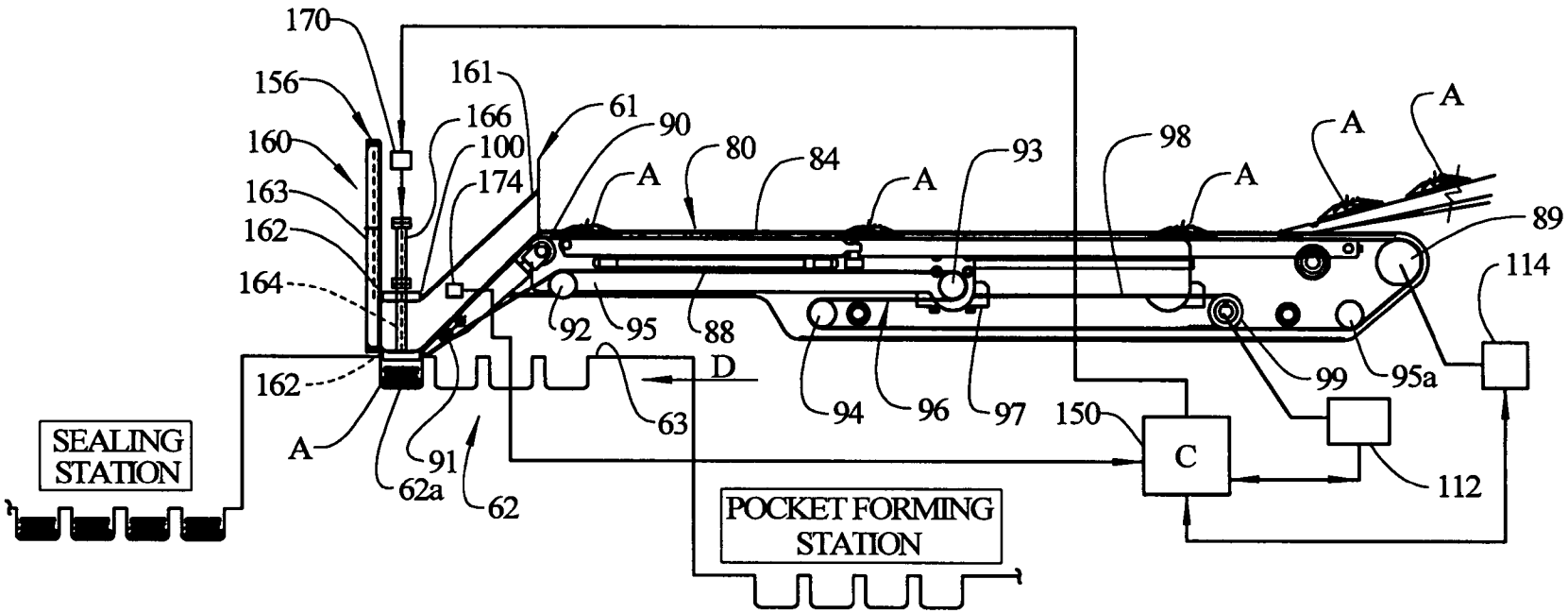
FIG. 2 is an enlarged, schematic elevational view from FIG. 1 of a pocket-filling apparatus of the invention in a first stage of operation.
Figure 3:
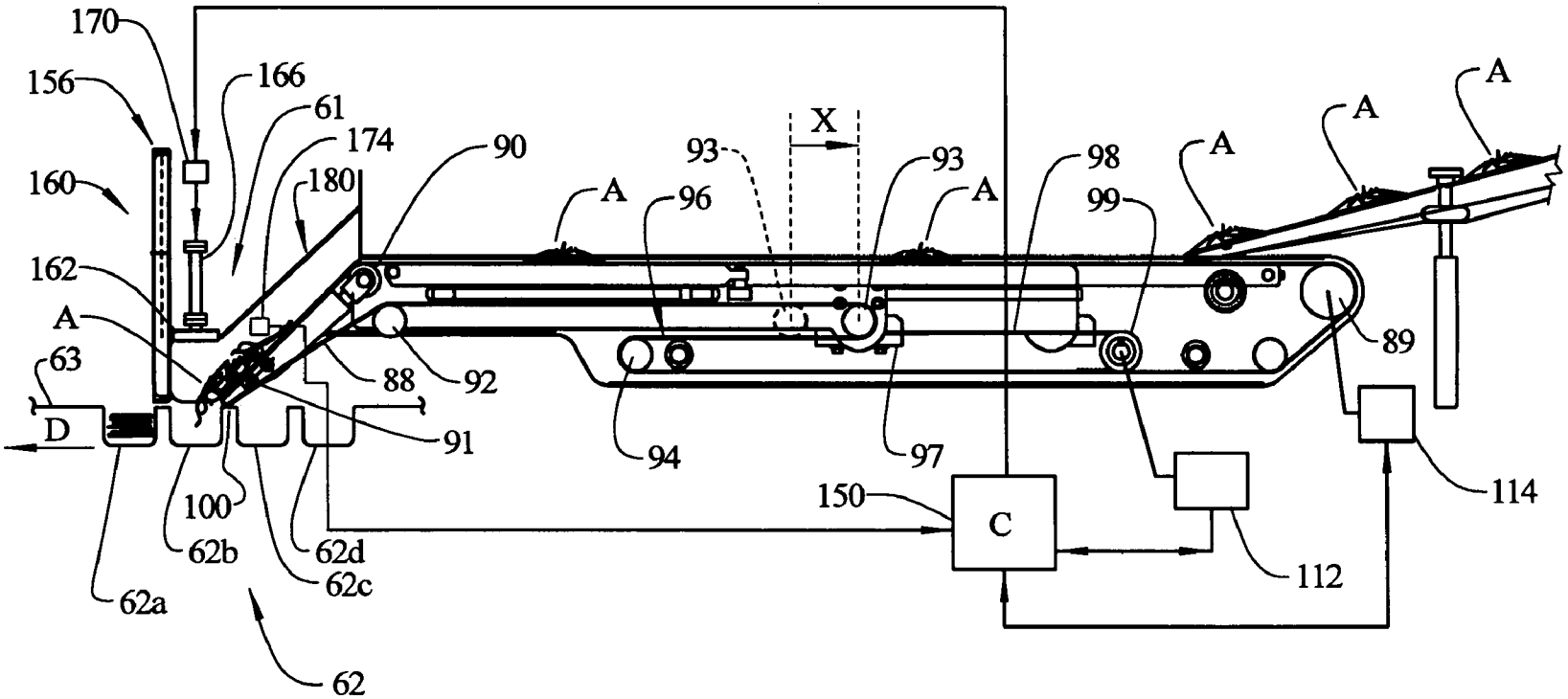
FIG. 3 is an enlarged, schematic elevational view of the pocket-filling apparatus of FIG. 2 in a second stage of operation.

FIGS. 2 and 3 illustrate that the shuttle conveyor 52 includes an endless belt 80. The belt 80 forms a top conveying region 84 and a bottom region 88. The belt 80 is wrapped around a stationary belt drive roller 89, an upper forward roller 90, an end roller 91, a bottom forward roller 92, an idler roller 93, a stationary bottom roller 94, and a stationary bottom back roller 95*a*. The rollers 90, 91, 92, 93 are rotationally mounted on front end sideplates 95 (one shown) to be translated back and forth together. The bottom region 88 of the belt, being wrapped around the movable idler roller 93 and the stationary bottom roller 94, effectively creates a belt accumulation region 96 between these rollers 93, 94. Controlled translation of the sideplates 95 holding the rollers 90, 91, 92, 93 controls the extension or retraction of the top region 84 of the beit 80, and the position of an end region 100 of the top region 84.

Two spaced-apart, sideby-side carriages 97 are provided. Each carriage 97 is connected to a corresponding front end sideplate 95. The rollers 90, 91, 92, 93 are effectively connected to the side-by-side carriages 97 (only one shown), via the front end sideplates 95. The carriages 97 are connected to a parallel pair of endless positioning belts 98 (only one shown). A servomotor 112 is operatively connected to the positioning belts 98, via drive pulleys 99, to drive an upper surface 98a of the belts 98 in either an advancing direction (downstream direction of the web of film movement) or a retracting direction (upstream direction of the web of film movement). The servomotor 112 thus controls the retraction and extension of the end region 100 via movement of the carriages 97. Another servomotor 114 is operatively connected to the drive roller 89 and controls the circulation speed of the conveying belt 80. A more detailed description of a shuttle conveyor and servomotor drive components is presented in U.S. patent application Ser. No. 10/201,047, filed Jul. 23, 2002, and is herein incorporated by reference.

A controller 150, such as a programmable logic controller (PLC), a microprocessor, a CPU or other control device, is signal connected to the servomotors 112, 114. The controller 150 synchronizes movement of the end region 100 of the conveyor 80 via the servomotor 112, and the speed of the belt 80 via the servomotor 114, with the movement of the web of film 63.

A tamping apparatus 156 is provided adjacent to the end 100 of the conveyor belt 80. The tamping apparatus 156 includes a row of tamping mechanism 160 (only one shown). The tamping mechanisms 160 are carried by plates 161 (only one shown) that are mechanically connected to the front end conveyor sideplates 95 to move with the end region 100 when the end region 100 is retracted or advanced. The mechanisms 160 each include a tamp plate 162 mounted on a rod 164. The tamp plate 162 is shown in an elevated position in FIG. 3, and in both an elevated and depressed (shown dashed) position in FIG. 2. The rod 164 is partially fit within, and actuated by, a pneumatic cylinder 166. When the rod 164 is extended, and the tamp plate 162 is depressed, the draft A is packed more tightly into a respective pocket 62*a*. The row of tamping mechanisms 160 correspond in number to the number of pockets in each row, i.e., each pocket within each row would be filled together and then tamped together by a corresponding tamping mechanism 160. Vertical supports 163 (shown schematically) connected to the plates 161 can be used to mount the pneumatic cylinders 166.

The pneumatic cylinder 166 is activated to raise or lower the rod 164 by a solenoid valve 170 that is signal-connected to the controller 150. An optical sensor (or sensors) 174 can be used to sense the presence or absence of a draft A on the ramp conveyor region 180. The optical sensor 174 is signal-connected to the controller 150. The synchronization of the tamping mechanisms 160 with the filling of the pockets 62 can be accomplished using the optical sensor 174 and/or information of the conveyor speed from the servomotor 114.

FIG. 3 illustrates that the movable rollers 90, 91, 92, 93, operatively carried by the front end sideplates 95, have been driven to the right by the carriages 97, that are driven by the servomotor 112, by an incremental distance x. The distance x is demonstrated in FIG. 3 by the change in position of the roller 93. The end region 100 is now in position to deposit the next row of drafts A into the second row of pockets 62*b*. The tamping mechanisms 160 are also shifted to be above the second row of pockets 62*b* and the process of depositing drafts A and tamping the drafts is repeated. The process is then repeated for each subsequent row 62*c*, 62*d*.

The end region 100 of the conveyor belt 80, is part of a ramp conveyor region 180 of the conveyor belt 80. The ramp conveyor region 180 is angled downwardly toward the rows of pockets 62 in order to controllably deposit drafts into the pockets. The ramp conveyor region 180 has a steep inclination which assists in tightening the drafts A entering the pockets 62.

The group of rows of pockets is preferably filled while the web of film 63 is stationary at the fill station 61, i.e., during the dwell period of the packaging operation. After the group is filled and the dwell period is over, the web of film 63 is moved in the direction D to reveal a new group of rows of pockets for filing. Preferably as the web of film 63 is moved the shuttle conveyor is advanced to be in a position to fill the first row of the new group.

Alternatively, the shuttle conveyor could fill the groups of rows in a reverse order to that just described, wherein the first filled row of pockets is the row furthest upstream in the web moving direction D, and the shuttle conveyor advances to fill the second row, then advances again to fill the third row, etc. After the group of rows is filled during the dwell period, the web of film advances to present an empty new group of rows of pockets and the shuttle conveyor retracts to be in a starting position to fill the new first row.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus for filling food product drafts into packages, comprising:

a supply of open top container portions arranged in rows that are displaced along a longitudinal direction and having a first row and a longitudinally displaced second row and carried by an elongated web of film and movable by said web along said longitudinal direction into a fill station; and a shuttle conveyor having a conveying surface, said shuttle conveyor comprises a device to retract and to extend said conveying surface, said conveying surface arranged above said fill station and having an end region longitudinally movable to a first position arranged to deposit food product drafts into said container portions of said first row by said conveying surface, and while said web remains stationary, said device retracts or extends said conveying surface to reposition said end region to a second position arranged to deposit food product drafts carried on said conveying surface into said container portions of said second row.

2. The apparatus according to claim 1, further comprising a tamping apparatus carried by said conveyor to be repositioned with said conveying surface end region and having vertically reciprocal tamping elements arranged above the respective first or second row being filled with food product drafts, said tamping elements actuatable to press said food product drafts into said container portions.

3. The apparatus according to claim 2, wherein said apparatus further comprises a rotatable slicing blade, a conveying assembly, and a support for holding a loaf in a cutting path of said rotatable slicing blade, said slicing blade arranged to rotate in said cutting path to slice drafts from said loaf, said drafts being plural slices formed in a pile on said conveying assembly, said conveying assembly including a staging conveyor that forms the piles into rows and transports said rows onto said conveying surface of said shuttle conveyor.

4. The apparatus according to claim 1, wherein said shuttle conveyor is configured to advance from a retracted position to an extended position to fill a new first row of a succeeding group of empty rows of container portions while said web advances to locate said succeeding group of empty rows of container portions in said fill station.

5. The apparatus according to claim 1, wherein said shuttle conveyor is configured to fill plural rows of container portions while said web is stationary in said fill station, and said shuffle conveyor is configured to retract from an extended position to a retracted position to fill a new first row of a succeeding group of empty rows of container portions while said web advances to locate said succeeding group of empty rows of container portions in said fill station.

6. The apparatus according to claim 1, wherein said container portions comprise concave formed portions of said web.

7. The apparatus according to claim 1, wherein said apparatus further comprises a sealing station downstream of said fill station, said sealing station arranged to apply a cover to said container portions to close said container portions.

8. The apparatus according to claim 1, wherein said apparatus further comprises a container portion-forming station upstream of said fill station, arranged to form said container portions of said web.

9. The apparatus according to claim 1, wherein said container portions comprise concave formed portions of said web;

wherein said apparatus further comprises a sealing station downstream of said fill station, said sealing station arranged to apply a cover to said container portions to close said container portions; and wherein said apparatus further comprises a container portion-forming station upstream of said fill station, configured to form said container portions of said web.

10. An apparatus for filling food product drafts into pockets formed into an elongated web of film, said pockets having open tops and arranged in rows that are displaced along a longitudinal direction and having at least a first row and a longitudinally displaced second row and movable with said web along said longitudinal direction, comprising:

a fill station and a mechanism for moving said pockets longitudinally into said fill station; and a shuttle conveyor having an endless belt conveying surface, said shuttle conveyor comprises a device to retract and to extend said conveying surface longitudinally, said conveying surface arranged above said fill station and having an end longitudinally movable to a first position arranged to deposit food product drafts into said pockets of said first row by said conveying surface, and while said web remains stationary, said device retracts or extends said conveying surface to longitudinally reposition said end to a second position arranged to deposit food product drafts carried on said conveying surface into said pockets of said second row.

11. The apparatus according to claim 10, further comprising a tamping apparatus carried by said conveyor to be longitudinally repositioned with said conveying surface end and having a row of vertically reciprocal tamping elements arranged above the respective first or second row being filled with food product drafts, said tamping elements actuatable to press said food product drafts into said pockets.

12. The apparatus according to claim 11, wherein said apparatus further comprises a rotatable slicing blade, a conveying assembly, and a support for holding a loaf in a cutting path of said rotatable slicing blade, said slicing blade arranged to rotate in said cutting path to slice drafts from said loaf, said drafts being plural slices formed in a pile on said conveying assembly, said conveying assembly including a staging conveyor that forms the piles into rows and transport said rows onto said conveying surface of said shuttle conveyor.

13. The apparatus according to claim 1, wherein said shuttle conveyor is configured to fill plural rows of pockets while said web is stationary in said fill station, and said shuttle conveyor is configured to advance from a retracted position to an extended position to fill a new first row of a group of empty pockets while said web advances to locate a succeeding plural row of pockets in said fill station.

14. The apparatus according to claim 10, wherein said shuttle conveyor is configured to fill plural rows of pockets while said web is stationary in said fill station, and said shuttle conveyor is configured to retract from an extended position to a retracted position to fill a new first row of a group of empty pockets while said web advances to locate a succeeding plural row of pockets in said fill station.

15. The apparatus according to claim 10, wherein said apparatus further comprises a sealing station downstream of said fill station, said sealing station arranged to apply a cover to said pockets to close said pockets.

16. The apparatus according to claim 10, wherein said apparatus further comprises a pocket-forming station upstream of said fill station, arranged to form said pockets of said web.

17. The apparatus according to claim 10, wherein said apparatus further comprises a sealing station downstream of said fill station, said sealing station configured to apply a cover to said container portions to close said container portions; and wherein said apparatus further comprises a pocket-forming station upstream of said fill station, arranged to form said pockets of said web.

18. The apparatus according to claim 17, further comprising a tamping apparatus carried by said conveyor to be longitudinally repositioned with said conveying surface end and having a row of vertically reciprocal tamping elements arranged above the respective first or second row being filled with food product drafts, said tamping elements actuatable to press said food product drafts into said pockets.

19. The apparatus according to claim 18, wherein said apparatus further comprises a rotatable slicing blade, a conveying assembly, and a support for holding a loaf in a cutting path of said rotatable slicing blade, said slicing blade arranged to rotate in said cutting path to slice drafts from said loaf, said drafts being plural slices formed in a pile on said conveying assembly, said conveying assembly including a staging conveyor that forms the piles into rows and transport said rows onto said conveying surface of said shuttle conveyor.

20. The apparatus according to claim 19, wherein said shuttle conveyor is configured to fill plural rows of pockets while said web is stationary in said fill station, and said shuttle conveyor is configured to advance from a retracted position to an extended position to fill a new first row of a group of empty pockets while said web advances to locate a succeeding plural row of pockets in said fill station.

21. The apparatus according to claim 19, wherein said shuttle conveyor is configured to fill plural rows of pockets while said web is stationary in said fill stalion, and said shuttle conveyor is configured to retract from an extended position to a retracted position to fill a new first row of a group of empty pockets while said web advances to locate a succeeding plural row of pockets in said fill station.

* * * * *

UNITED STATES PATENT AND TRADEMARK OFFICE

CERTIFICATE OF CORRECTION

PATENT NO. : 7,065,936 B2
APPLICATION NO. : 10/323618
DATED : June 27, 2006
INVENTOR(S) : Scott A. Lindee and Glenn Sandberg It is certified that error appears in the above-identified patent and that said Letters Patent is hereby corrected as shown below:

At column 7, line 30, change “transport” to --transports--.

At column 7, line 32, change “1” to --10--.

At column 8, line 30, change “transport” to --transports--.

At column 8, line 41, change “stalion” to --station--.

Signed and Sealed this

Seventeenth Day of October, 2006

JON W. DUDAS
*Director of the United States Patent and Trademark Office*